US007823703B2

(12) United States Patent
Amano

(10) Patent No.: US 7,823,703 B2
(45) Date of Patent: Nov. 2, 2010

(54) IMAGE MONITORING APPARATUS FOR ELEVATOR

(75) Inventor: Masaaki Amano, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/468,889

(22) Filed: May 20, 2009

(65) Prior Publication Data

US 2009/0223749 A1 Sep. 10, 2009

Related U.S. Application Data

(62) Division of application No. 10/593,711, filed as application No. PCT/JP2005/003475 on Mar. 2, 2005.

(51) Int. Cl.
*B66B 1/34* (2006.01)

(52) U.S. Cl. ..... 187/392; 187/247; 187/384

(58) Field of Classification Search ..... 187/247, 187/380–388, 391–396
See application file for complete search history.

(56) References Cited

U.S. PATENT DOCUMENTS

| | | | | |
|---|---|---|---|---|
| 4,839,631 | A * | 6/1989 | Tsuji | 340/541 |
| 5,131,508 | A * | 7/1992 | Suzuki | 187/380 |
| 5,258,586 | A * | 11/1993 | Suzuki et al. | 187/392 |
| 7,284,639 | B2 * | 10/2007 | Sasaki et al. | 187/395 |
| 2007/0151808 | A1 * | 7/2007 | Amano | 187/391 |
| 2009/0223750 | A1 * | 9/2009 | Amano | 187/392 |
| 2009/0229925 | A1 * | 9/2009 | Amano | 187/392 |

FOREIGN PATENT DOCUMENTS

| | | | |
|---|---|---|---|
| JP | 01317975 | A * | 12/1989 |
| JP | 05162939 | A * | 6/1993 |
| JP | 06156912 | A * | 6/1994 |
| JP | 8-277080 | | 10/1996 |
| JP | 11-228046 | | 8/1999 |
| JP | 2001-335252 | | 12/2001 |
| JP | 2003-321168 | | 11/2003 |
| JP | 2004-56260 | | 2/2004 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

In an image monitoring apparatus for an elevator, an image recording unit records an image in a car photographed by a camera, and monitors based on the image in the car whether or not there is a violent behavior of a passenger in the car. The image recording unit makes a recording density of the image in the car higher than usual when the violent behavior of the passenger in the car is detected. The operation control unit homes the car on a predetermined floor when the violent behavior of the passenger in the car is detected by the image recording unit.

4 Claims, 3 Drawing Sheets

IMAGE MONITORING APPARATUS FOR ELEVATOR

CROSS-REFERENCE TO RELATED APPLICATIONS

This application is a divisional of and claims benefit of priority under 35 U.S.C. §120 from U.S. Ser. No. 10/593,711 filed Sep. 21, 2006, the entire contents of which is incorporated herein by reference. U.S. Ser. No. 10/593,711 is a National Stage of PCT/JP05/03475 filed Mar. 2, 2005 which was not published under PCT Article 21(2) in English.

TECHNICAL FIELD

The present invention relates to an image monitoring apparatus for an elevator which detects a violent behavior of a passenger in a car from an image in the car which has been photographed by a camera.

BACKGROUND ART

In a conventional monitoring system for an elevator, an image in a car which has been photographed by a camera is transmitted to a maintenance company when no call is registered within a predetermined time despite detection of a passenger by car weight detecting means (e.g., see Patent Document 1).

Patent Document 1: JP 2004-59260 A

DISCLOSURE OF THE INVENTION

Problem to be Solved by the Invention

However, in the above-mentioned conventional monitoring system for the elevator, the image in the car is transmitted to the maintenance company only after no call has been registered for a predetermined time. Therefore, it took a long time to detect an abnormality, so the crime deterrent effect was insufficient.

The present invention has been made to solve the problem described above, and it is an object of the present invention to obtain an image monitoring apparatus for an elevator which capable of detecting an abnormality in a car earlier and enhancing the crime deterrent effect.

Means for Solving the Problem

An image monitoring apparatus for an elevator according to the present invention includes image recording means for recording an image in a car photographed by a camera, and monitoring based on the image in the car whether or not there is a violent behavior of a passenger in the car, in which the image recording means makes a recording density of the image in the car higher than usual when the violent behavior of the passenger in the car is detected.

BEST MODE FOR CARRYING OUT THE INVENTION

A preferred embodiment of the present invention will be described hereinafter with reference to the drawings.

EMBODIMENT 1

Figure 1:
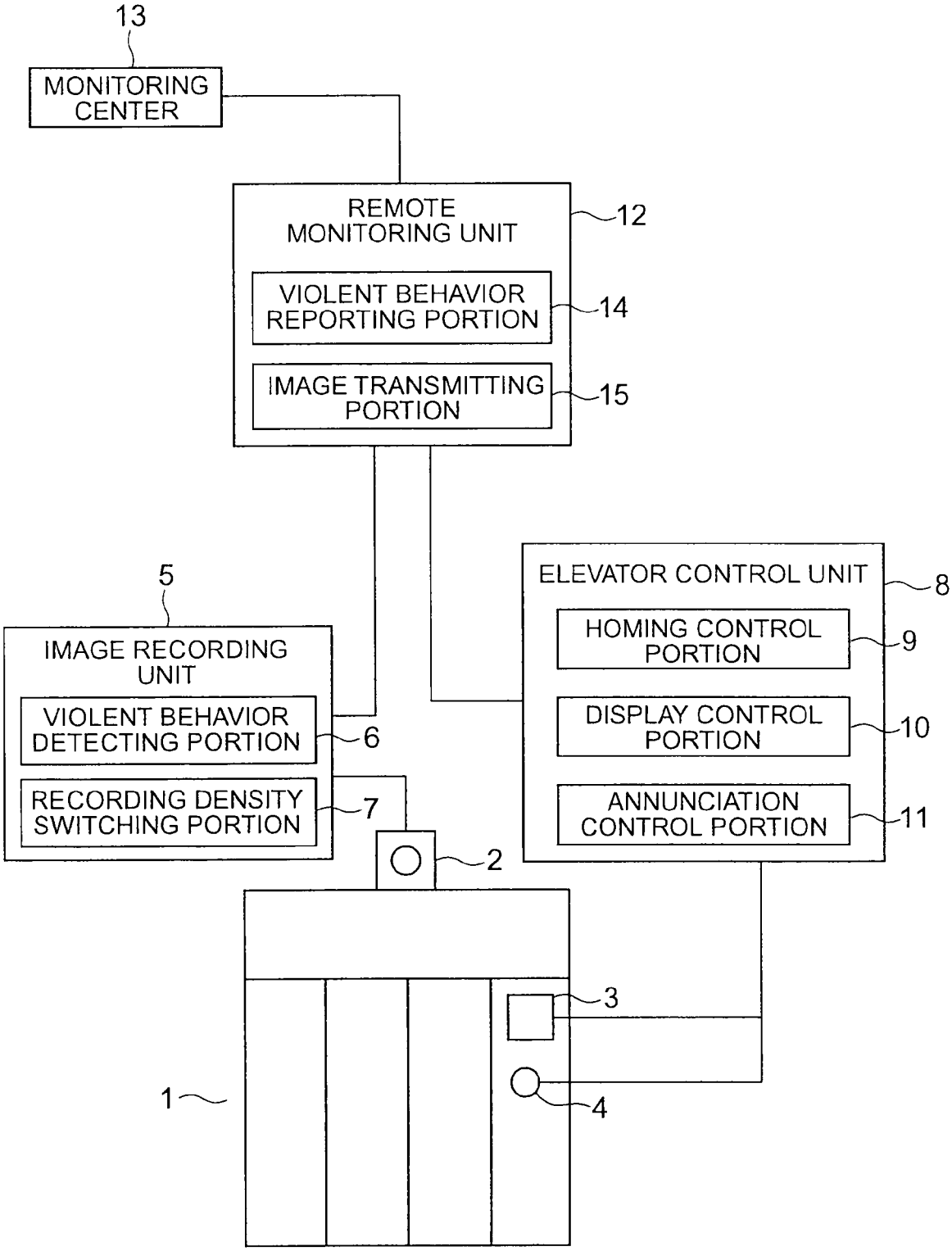
FIG. 1 is a block diagram showing an image monitoring apparatus for an elevator according to Embodiment 1 of the present invention.

FIG. 1 is a block diagram showing an image monitoring apparatus for an elevator according to Embodiment 1 of the present invention. Referring to the figure, a camera 2 for photographing an interior of a car (car chamber) 1 is installed therein. A display unit 3 for displaying floor information and the like and an announcement unit 4 for outputting audio information is provided in the car 1.

An image in the car 1 photographed by the camera 2 is recorded by an image recording unit 5 serving as image recording means. The image recording unit 5 is mounted, for example, on the car 1. Further, the image recording unit 5 records images photographed by the camera 2 at intervals of a predetermined time (e.g., one second). Moreover, the image recording unit 5 is made up of a computer including a calculation processing portion (CPU), a recording portion (ROM, RAM, hard disk, and the like), signal input/output portions, and the like. To be more specific, the images photographed by the camera 2 is stored in a hard disk.

Furthermore, the image recording unit 5 has a violent behavior detecting portion 6 for monitoring based on the image in the car 1 whether or not there is a violent behavior of a passenger in the car 1, and a recording density switching portion 7 for making a recording density of images in the car 1 higher than usual when the violent behavior of the passenger in the car 1 is detected. The violent behavior detecting portion 6 compares a newly photographed image in the car 1 with a last photographed image in the car 1, and then determines that the passenger has behaved violently when a moving amount (moving speed) of the passenger has exceeded a reference value.

To be more specific, the recording density switching portion 7 makes a switch in recording frequency of an image. The recording frequency represents a number of images recorded per unit time (frame rate). For instance, the recording density switching portion 7 usually records an image once in one second, but five times in one second when a violent behavior is detected.

The functions of the violent behavior detecting portion 6 and the recording density switching portion 7 are realized by the computer constituting the image recording unit 5. In other words, programs for realizing the functions of detecting a violent behavior and making a switch in recording density are stored in the ROM of the image recording unit 5. The CPU of the image recording unit 5 performs calculation processings based on the programs stored in the ROM. Detection of a violent behavior and a switch in recording density are thereby carried out.

Operation of the car 1 is controlled by an elevator control unit 8 serving as operation control means. The elevator control unit 8 is installed in, for example, a hoistway or a machinery room. The elevator control unit 8 is made up of a computer including a calculation processing portion (CPU), a recording portion (ROM, RAM, hard disk, and the like), signal input/output portions, and the like.

In addition, the elevator control unit 8 has a homing control portion 9, a display control portion 10 for controlling the display unit 3, and an annunciation control portion 11 for controlling the announcement unit 4. The homing control portion 9 causes the car 1 to home on a nearest floor when a violent behavior of the passenger in the car 1 is detected by the image recording unit 5.

The display control portion 10 causes the display unit 3 to display an image in the car 1 when a violent behavior of the passenger in the car 1 is detected by the image recording unit 5. When the violent behavior of the passenger in the car 1 is detected by the image recording unit 5, the annunciation control portion 11 issues to the interior of the car 1 an announcement that the violent behavior has been detected.

The functions of the homing control portion 9, the display control portion 10, and the annunciation control portion 11 are realized by the computer constituting the elevator control unit 8. That is, programs for realizing the functions of homing the car 1, displaying an image in the car 1, and annunciating detection of a violent behavior in the car 1 are stored in the ROM of the elevator control unit 8. The CPU of the elevator control unit 8 performs calculation processings based on the programs stored in the ROM. The homing of the car 1, display of the image in the car 1, and annunciation of detection of the violent behavior are thereby carried out.

The image recording unit 5 and the elevator control unit 8 are communicably connected to a remote monitoring unit 12 serving as remote monitoring means. The remote monitoring unit 12 monitors a control state of operation of the car 1 which is performed by the elevator control unit 8, and sends information on the control state to a remote monitoring center 13. The remote monitoring unit 12 is installed in, for example, an administrative room in a building. In addition, image recording units and elevator control units for a plurality of elevators installed in the same building, for example, are connected to the remote monitoring unit 12.

The monitoring center 13 administrates in a centralized manner a plurality of elevators installed in various locations. The remote monitoring unit 12 and the monitoring center 13 are connected to each other via, for example, a general public circuit.

The remote monitoring unit 12 is made up of a computer including a calculation processing portion (CPU), a recording portion (ROM, RAM, hard disk, and the like), signal input/output portions, and the like. The remote monitoring unit 12 has a violent behavior reporting portion 14 and an image transmitting portion 15. The violent behavior reporting portion 14 receives a violent behavior detection signal from the image recording unit 5, and reports to the elevator control unit 8 and the monitoring center 13 that a violent behavior has been detected. When the violent behavior of the passenger in the car 1 is detected by the image recording unit 5, the image transmitting portion 15 receives data on an image in the car 1 from the image recording unit 5, and transmits the data to the elevator control unit 8 and the monitoring center 13.

The functions of the violent reporting portion 14 and the image transmitting portion 15 are realized by the computer constituting the remote monitoring unit 12. That is, programs for realizing the functions of reporting a violent behavior and transmitting an image are stored in the ROM of the remote monitoring unit 12. The CPU of the remote monitoring unit 12 performs calculation processings based on the programs stored in the ROM. The reporting of the violent behavior and transmission of the image are thereby carried out.

After the violent behavior has been detected, the image recording unit 5 continues to record images with a high density, and transmits copied data on the recorded images to the remote monitoring unit 12 in succession. In addition, the remote monitoring unit 12 transmits the image data received from the image recording unit 5 to the monitoring center 13 and the elevator control unit 8 in succession. In accordance with the image data received from the remote monitoring unit 12, the elevator control unit 8 causes the display unit 3 to display the images in the car 1 in succession.

Figure 2:
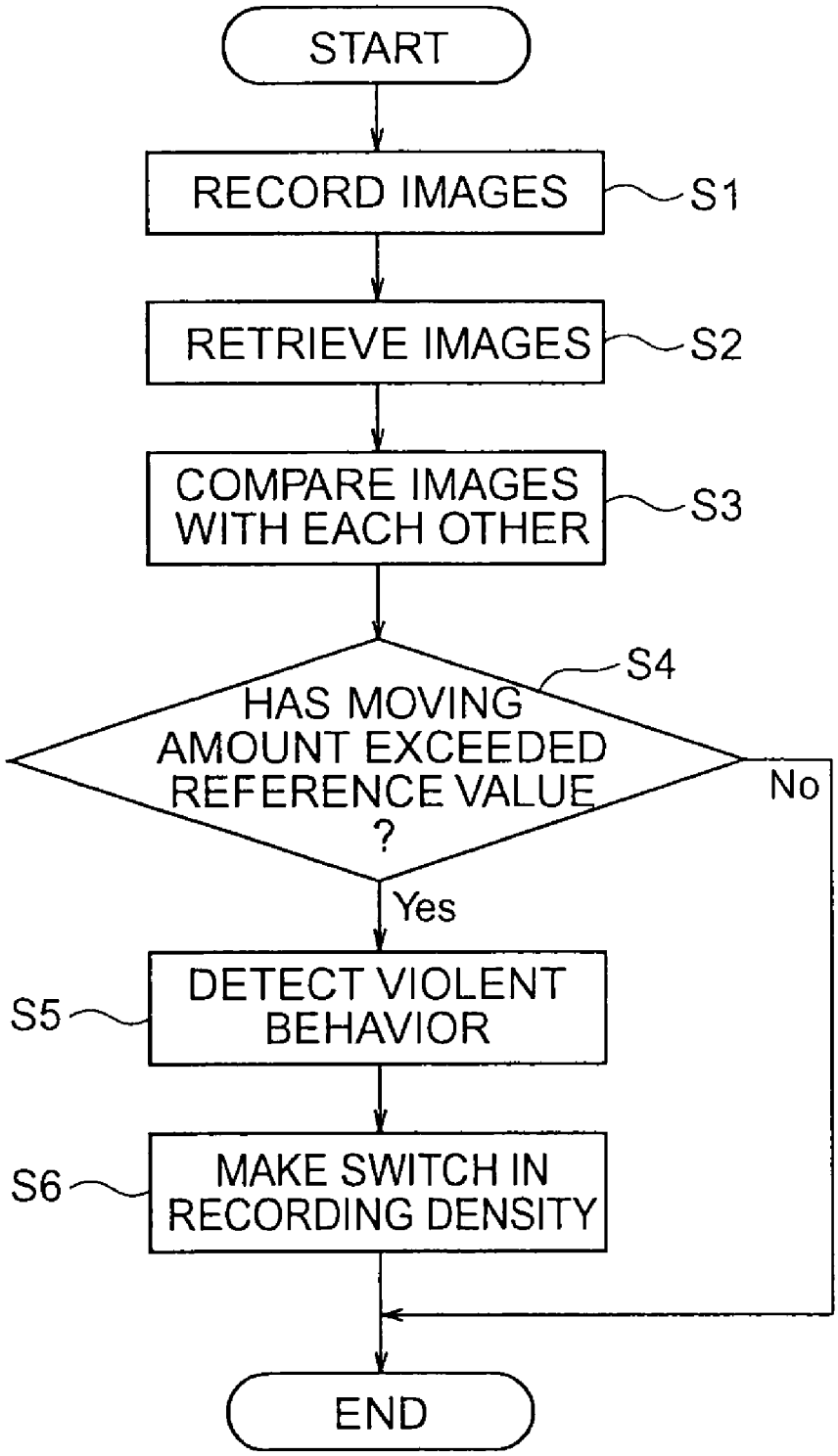
FIG. 2 is a flowchart showing an operation of an image recording unit shown in FIG. 1.

FIG. 2 is a flowchart showing an operation of the image recording unit 5 shown in FIG. 1. The image recording unit 5 repeatedly performs an operation shown in FIG. 2 at predetermined intervals. In the operation of the image recording unit 5, an image photographed by the camera 2 is first recorded onto the hard disk (step S1). Next, a newly recorded image and a last recorded image are retrieved (step S2), and those two images are compared with each other (step S3). Then, a passenger in the images is specified through an image processing, and it is determined whether or not a moving amount of the passenger has exceeded a reference value (step S4). When the moving amount of the passenger has not exceeded the reference value, the operation for that time is terminated.

When the moving amount of the passenger has exceeded the reference value, it is determined that the passenger has behaved violently, and then a violent behavior detection signal is outputted to the remote monitoring unit 12 (step S5). Then, the recording density of images is made higher than usual (step S6).

Figure 3:
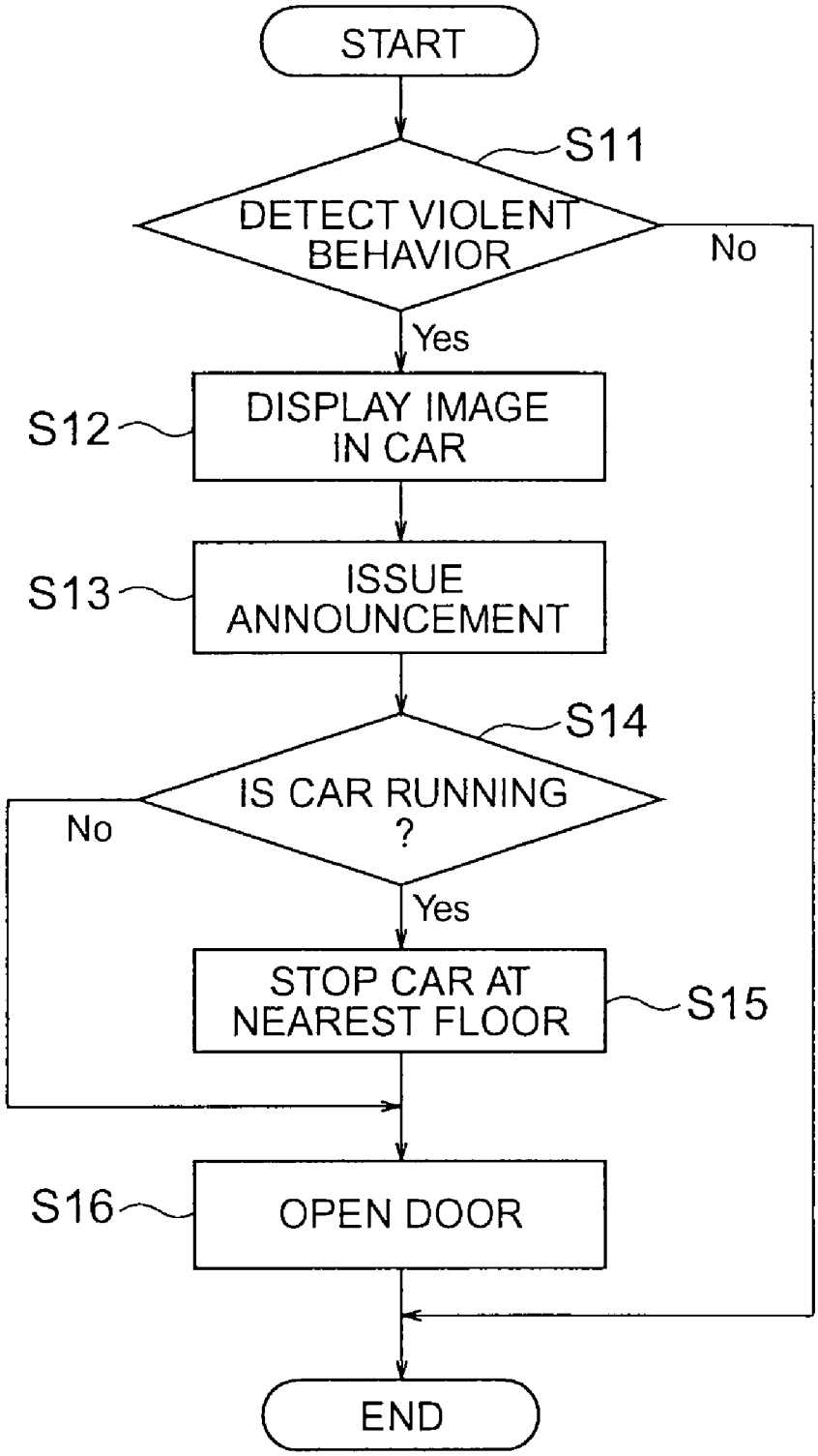
FIG. 3 is a flowchart showing an operation of an elevator control unit shown in FIG. 1 at a time when a violent behavior of a passenger is detected.

FIG. 3 is a flowchart showing an operation of the elevator control unit 8 of FIG. 1 at a time when a violent behavior has been detected. The elevator control unit 8 confirms at predetermined intervals whether or not detection of the violent behavior has been reported by the remote monitoring unit 12 (step S11). When detection of the violent behavior has not been reported, the operation for that time is terminated.

When detection of the violent behavior has been reported, the elevator control unit 8 receives an image in the car 1 from the remote monitoring unit 12 and causes the display unit 3 to display the image (step S12). Further, the elevator control unit 8 causes the announcement unit 4 to issue an announcement that the violent behavior has been detected (e.g., "A crime has been detected. We will stop at a nearest floor.") (step S13). The elevator control unit 8 then confirms whether or not the car 1 is running (step S14). When the car 1 is running, the elevator control unit 8 stops the car 1 at the nearest floor (step S15), and opens a door of the car and a door of a landing at the nearest floor (step S16). When the car 1 is stopped at a certain floor, the elevator control unit 8 performs an operation of opening the door of the car 1 at the floor.

In the image monitoring apparatus for such an elevator, the images in the car 1 are compared with each other, so a violent behavior of a passenger is automatically detected. Therefore, an abnormality in the car 1 can be detected earlier.

When the violent behavior of the passenger in the car 1 is detected, the recording density of the images in the car 1 is made higher than usual. Thus, the situation in which the passenger has behaved violently can be recorded in detail, so the crime deterrent effect can be enhanced. Moreover, the recording density of the images is usually lowered to record them efficiently.

Furthermore, when a violent behavior of the passenger in the car 1 is detected, the car 1 is caused to home on the nearest floor. Thus, the crime deterrent effect can be enhanced.

Still further, when a violent behavior of the passenger in the car 1 is detected, the display unit 3 installed in the car 1 is caused to display an image in the car 1. Thus, the crime deterrent effect can be enhanced.

Further, when a violent behavior of the passenger in the car 1 is detected, an announcement that the violent behavior has been detected is issued to the interior of the car 1. Thus, the crime deterrent effect can be enhanced.

Furthermore, when a violent behavior of the passenger in the car 1 is detected, detection of the violent behavior is reported from the remote monitoring unit 12 to the monitoring center 13. Thus, the crime deterrent effect can be enhanced.

Still further, when a violent behavior of a passenger in the car 1 is detected, an image in the car 1 is transmitted from the remote monitoring unit 12 to the monitoring center 13. Thus, the crime deterrent effect can be enhanced. Since an image is transmitted to the monitoring center 13 only when a violent behavior is detected, the utility rate for the general public circuit can be curtailed.

In the foregoing example, the remote monitoring unit 12 is interposed between the image recording unit 5 and the elevator control unit 8. However, the image recording unit 5 and the elevator control unit 8 may be directly connected to each other, and the remote monitoring unit 12 may receive information from the image recording unit 5 via the elevator control unit 8.

In the foregoing example, the image recording unit 5, the elevator control unit 8, and the remote monitoring unit 12 are made up of computers that are independent of one another. However, the functions of those units may be performed by one or two computers. Conversely, those functions may be allocated to and performed by four or more computers.

Moreover, in the foregoing example, the car 1 is moved to the nearest floor upon detection of a violent behavior. However, the car 1 may be moved to a specific floor where a security guard is on watch or to an entrance floor or the like.

Still further, the announcement may be issued to the interior of the car 1 in a non-acoustic manner. For example, the display unit 3 may be caused to display a message, or an indicator lamp having the message printed thereon may be lit up.

The violent behavior detecting portion 6 may compare only certain regions (e.g., upper regions) of the images in the car 1 with each other instead of simply comparing the entire images with each other. Thus, the accuracy in detecting a violent behavior can be enhanced.

The invention claimed is:

1. An image monitoring apparatus for an elevator, comprising:

operation control means for controlling operation of a car; and image recording means for recording an image in the car photographed by a camera, and for detecting, based on the image in the car, whether or not there is a violent behavior of a passenger in the car, wherein when the violent behavior of the passenger in the car is detected by the image recording means, the operation control means determines whether the car is moving, and if the car is determined to be moving, moves the car to a nearest floor, and if the car is determined to be not moving, opens a door of the car.

2. An image monitoring apparatus for an elevator, comprising:

an operation control unit configured to control operation of a car; and an image recording unit configured to record an image in the car photographed by a camera, and to detect, based on the image in the car, whether or not there is a violent behavior of a passenger in the car, wherein, when the violent behavior of the passenger in the car is detected by the image recording unit, the operation control unit determines whether the car is moving, and if the car is determined to be moving, moves the car to a nearest floor, and if the car is determined to be not moving, opens a door of the car.

3. An image monitoring method for an elevator, the method comprising:

controlling operation of a car;

recording an image in the car photographed by a camera;

detecting, based on the image in the car, whether or not there is a violent behavior of a passenger in the car; and determining, when the violent behavior of the passenger in the car is detected in the detecting step, whether the car is moving, and if the car is determined to be moving, moving the car to a nearest floor, and if the car is determined to be not moving, opening a door of the car.

4. The image monitoring apparatus of claim 1, wherein the image recording means comprises:

means for recording a sequence of images of an interior of the car; and means for detecting the violent behavior of the passenger in the car by comparing only certain regions of each of successive images in the sequence of images of the interior of the car.

* * * * *